US006564392B1

(12) United States Patent
Buckwald

(10) Patent No.: US 6,564,392 B1
(45) Date of Patent: May 20, 2003

(54) SOCK INSERT

(76) Inventor: Vernon L. Buckwald, 2423 Foothill Blvd., Apt. B306, La Crescenta, CA (US) 91214-3594

( * ) Notice: Subject to any disclaimer, the term of this patent is extended or adjusted under 35 U.S.C. 154(b) by 0 days.

(21) Appl. No.: 09/945,478

(22) Filed: Sep. 4, 2001

(51) Int. Cl.[7] ..... A41B 11/00
(52) U.S. Cl. ..... 2/239
(58) Field of Search ..... 2/239, 240, 241, 2/242, 409, 61; D2/903, 919, 920

(56) References Cited

U.S. PATENT DOCUMENTS

| | | | | | |
|---|---|---|---|---|---|
| 832,550 | A | * | 10/1906 | Lepper | 2/239 |
| 962,089 | A | * | 6/1910 | Newton | 2/239 |
| 1,368,255 | A | * | 2/1921 | Hall | 2/239 |
| 1,726,441 | A | * | 8/1929 | Loven | 2/239 |
| 1,889,716 | A | * | 11/1932 | Walker | 2/239 |
| 2,391,064 | A | * | 12/1945 | McCandless | 2/239 |
| 2,412,087 | A | * | 12/1946 | Herbert | 66/187 |
| 2,674,740 | A | * | 4/1954 | Kidd | 2/61 |
| 3,334,356 | A | * | 8/1967 | Abel | 2/239 |
| 3,417,408 | A | * | 12/1968 | Caggiano | 2/239 |
| 5,878,442 | A | * | 3/1999 | Pejak | 2/409 |
| 6,044,497 | A | * | 4/2000 | Richardson | 2/239 |
| 6,336,227 | B1 | * | 1/2002 | Liput et al. | 2/239 |

* cited by examiner

*Primary Examiner*—John J. Calvert
*Assistant Examiner*—Alissa L. Hoey
(74) *Attorney, Agent, or Firm*—Donald R. Schoonover

(57) ABSTRACT

A sock is protected against wear due to rubbing against a wearer's toes by a sleeve that is placed over the wearer's toes in order to be interposed between the wearer's toes and the inside of the sock. The sleeve fits inside the sock and covers only the wearer's toes so the protected sock is comfortable to wear.

4 Claims, 1 Drawing Sheet

SOCK INSERT

BACKGROUND OF THE INVENTION

1. Field of the Invention

The present invention relates to the general art of wearing apparel, and to the particular field of wearing apparel for the foot.

2. Discussion of the Related Art

The inventor has observed that many socks are worn out before their time because a hole is worn through the sock. Such a sock must either be sewn up or discarded. If discarded, a matching sock may become worthless thereby aggravating the loss. Time and expense must be expended to sew the sock if it is to be repaired. Often a repaired sock is not as desirable as an unrepaired sock.

Therefore, there is a need for a means for protecting a sock from being worn away by contact between a wearer's foot and the sock during use of the sock.

The inventor has also observed that many socks become worn in the toe portion thereof. This is due to the pressure placed on the sock by a walking motion during use of the sock or due to a wearer's toe nail wearing through the sock. Because of the particular motion executed by some people when they walk, the rubbing contact between the toe, or toes, of the wearer and the sock eventually wears a hole in the sock. Once a hole has been worn in the sock, the above-discussed problems occur.

Therefore, there is a need for a means for protecting a toe portion of a sock from being worn away by contact between a wearer's foot and the sock during use of the sock.

The wearing apparel art has many examples of foot wear. Some of these examples include socks. Some of these socks have a double layer of material in the sock. However, this makes the sock more expensive to manufacture, thicker, more cumbersome and less versatile. All, or any, of these factors make the sock less desirable.

Some people may actually wear two socks. However, this is not desirable since this may be hot on the wearer's foot and/or uncomfortable due to the added thickness of the sock. This may also be expensive since it requires an extra sock in a situation where one sock should suffice.

Accordingly, there is a need for a means for protecting a sock from being worn away by contact between a wearer's foot and the sock during use of the sock and which does not add any discomfort to the wearer.

Still further, it is desirable for some socks to be worn in several different situations. This will make the socks efficient and economical. Thus, it may be desirable for some socks to be worn in a dress situation where little walking may occur, yet also be worn in other situations where a great deal of walking may occur. In the first situation, the sock may not need to be protected; whereas, in the second situation, the sock may need to be protected. A sock with added protection may be expensive or cumbersome in the first situation, yet an unprotected sock may not suffice for the latter situation. This may force a wearer into either wearing an overly cumbersome sock for a situation that does not require a protected sock, or to wear a sock that is not really suited for another situation.

Therefore, there is a need for a means for protecting a sock from being worn away by contact between a wearer's foot and the sock during use of the sock and which permits a sock to be worn in a manner that is most efficient for a particular situation.

PRINCIPAL OBJECTS OF THE INVENTION

It is a main object of the present invention to provide a means for protecting a sock from being worn away by contact between a wearer's foot and the sock during use of the sock.

It is another object of the present invention to provide a means for protecting a sock from being worn away by contact between a wearer's foot and the sock during use of the sock and which does not add any discomfort to the wearer.

It is another object of the present invention to provide a means for protecting a toe portion of a sock from being worn away by contact between a wearer's foot and the sock during use of the sock.

It is another object of the present invention to provide a means for protecting a sock from being worn away by contact between a wearer's foot and the sock during use of the sock and which permits a sock to be worn in a manner that is most efficient for a particular situation.

SUMMARY OF THE INVENTION

These, and other, objects are achieved by providing a means that protects only the toe portion of a sock during use. A sock protector is worn when a situation is anticipated that a sock will be stressed and is not used in other situations. For example, if the wearer anticipates that he or she will do a great deal of walking, the sock protector is worn; however, if the wearer anticipates a great deal of standing or sitting, such as may occur in a dress situation, the sock protector may not be needed. However, the same sock can be worn in both situations making the sock versatile. The protector is worn over the toes of the wearer to locate the protection in the exact area that generally is most vulnerable to being worn away by contact with the wearer's foot while leaving unprotected those areas of the sock that do not need such protection.

In this manner, the sock can be manufactured in the most efficient manner, yet a protected sock will not be unreasonably cumbersome, hot or thick. Specifically, only the area of the sock that is most likely to wear away is fully protected without protecting other areas whereby a sock can be protected without adding significant cost or material to the sock. It is also noted that the toe area of a sock or shoe generally has the most extra room and thus a wearer's foot will not be overly restricted by adding a sock protector only at the toe area of the foot; whereas, adding material to other areas may overly-restrict a wearer's foot. Thus, one problem (protecting a sock) is solved without creating other problems (such as overly-restricting a wearer's foot).

A sock can be manufactured in the most cost-effective manner, yet be adaptable to several different situations. Thus, a sock can be manufactured to have only a single layer of thickness, yet by using the sock protector included in the present invention, the sock can be used in situations where thick socks are most efficient. This makes the sock versatile, comfortable and efficient, yet inexpensive.

DETAILED DESCRIPTION OF THE INVENTION

Figures 1, 2, 3:
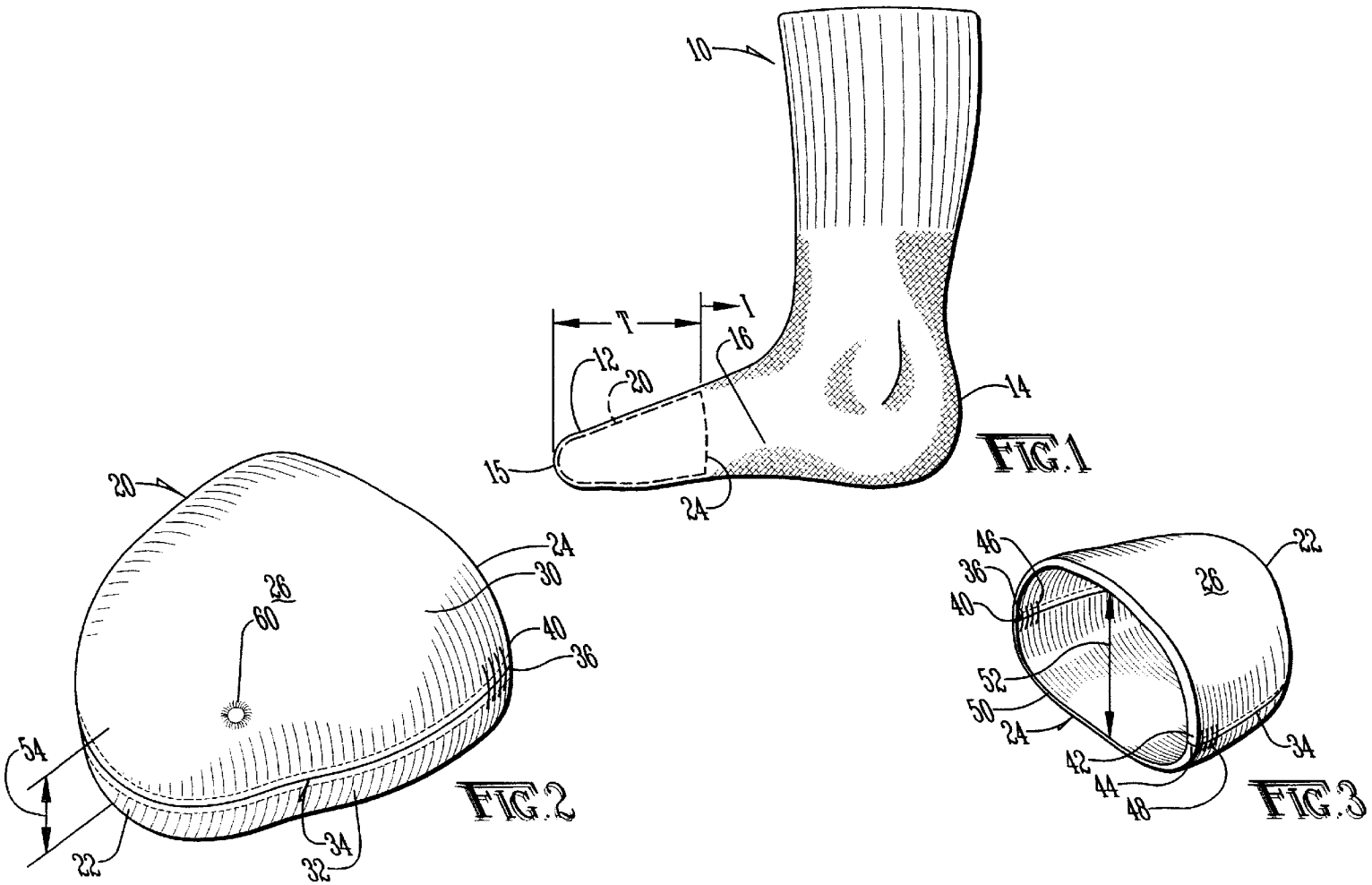
FIG. 1 is a sock having a sock protector located in the toe portion thereof in accordance with the teaching of the present invention.
FIG. 2 is an enlarged, front perspective view of a sock protector of the present invention.
FIG. 3 is a rear perspective view of the sock protector shown in FIG. 2.

Other objects, features and advantages of the invention will become apparent from a consideration of the following detailed description and the accompanying drawings.

In accordance with the teaching of the present invention, a sock is protected by a wearer donning a special sock protector over his or her toes before donning a sock. This places protection in the most effective area and an area that will most easily accommodate extra material without adding material to other areas of the sock, such as the instep portion, that may be unnecessary to protect and which may create a situation that overly-restricts a wearer's foot by placing extra material in the shoe in locations that cannot readily accommodate such extra material. Thus, by protecting only the area most likely to wear out, the sock can be efficient and cost-effective to manufacture, as well as comfortable to wear.

Referring first to FIG. 1, it can be seen that a sock 10 is formed of knit material, such as cotton, nylon or the like and includes a toe portion 12, a heel portion 14 and an instep portion 16 connecting toe portion 12 to heel portion 14 of the sock. As above discussed, in some situations, the sock may become worn in toe portion 12 by rubbing between a wearer's toe and toe portion 12 of sock 10. This often wears a hole in sock 10 and may be wasteful. As used in the present disclosure, the toe portion 12 of the sock 10 extends rearwardly from the forwardmost end 15 of the sock 10 and is represented by dimension T, with instep portion 16 extending rearwardly from the toe portion 12 as indicated in FIG. 1 by arrow I. The toe portion 12 of the sock 10 will fit over a wearer's toes between the front tip of the wearer's toes (forward of the toe nails) and the transverse arch of the wearer's foot where the toes join the rest of the foot. This portion of a sock 10 is generally established when the size of the sock is determined by a manufacturer and need not depend entirely on the size of the wearer's foot.

The sock protector included in the present invention further includes a sleeve 20, best shown in FIGS. 2 and 3. Sleeve 20 has a forwardmost end 22 which will be located immediately adjacent to the inside of forwardmost end 15 of the sock and the front tip of the wearer's toes and will be immediately interposed therebetween when the sleeve 20 is worn. Sleeve 20 further includes a rearwardmost end 24 and a body 26 connecting forwardmost end 22 to rearwardmost end 24. Body 26 has an upper section 30, a lower section 32 which will be located beneath a wearer's toes when the sleeve is in position on the wearer's foot. A sewn seam 34 connects upper section 30 of body 26 to lower section 32 of body 26. Sewn seam 34 has a first end 36 that intersects rearwardmost end 24 of sleeve 20 at a first area 40 of rearwardmost end 24 of sleeve 20 and a second end 42 intersecting rearwardmost end 24 of sleeve 20 at a second area 44 of rearwardmost end 24 of sleeve 20 and extends around body 26. First and second reinforcing elements 46 and 48 are located in first and second areas 40 and 44 respectively.

As can best be seen in FIG. 3, rearwardmost end 24 of sleeve 20 is open and has a rim 50 that extends on upper section 30 of body 26 of sleeve 20 and on first and second ends 36 and 42 of sewn seam 34 and on lower section 32 of body 26 of sleeve 20 to completely encircle rearwardmost end 24. Rearwardmost end 24 of sleeve 20 has a first inner dimension 52 and forwardmost end 22 of sleeve 20 has a second inner dimension 54 immediately adjacent to the toe portion of the sleeve. First inner dimension 52 is larger than second inner dimension 54 with body 26 of sleeve 20 tapering in size from first inner dimension 52 to second inner dimension 54 to snugly fit around the toes of a wearer. Thus, sleeve 20 is roughly conical in shape.

As can be seen in FIG. 1, sleeve 20 is entirely located inside toe portion 12 of sock 10 with rearwardmost end 24 of sleeve 20 being positioned in toe portion 12 of sock 10 and is located forwardly of the instep portion 16 of sock 10 when in use whereby only the toes of a wearer are covered by sleeve 20 when that sleeve is worn by the wearer. As shown in FIG. 1, rearwardmost end 24 is located substantially at the intersection of sock toe portion 12 and sock instep portion 16; however, rearwardmost end 24 can be located closer to toe end 15 of sock 10 if desired whereby some of the sock toe portion 12 is not covered by sleeve 20.

In one form of the invention, sleeve 20 is constructed of nylon or rayon or a mix of the two in order to be comfortable yet strong. One form of the invention has a rearwardmost end dimension 52 of approximately five inches and a body dimension between rearwardmost end 24 and forwardmost end 22 of approximately 4.75 inches. A vent hole 60 can also be included to make the sleeve even more comfortable.

It is understood that while certain forms of the present invention have been illustrated and described herein, it is not to be limited to the specific forms or arrangements of parts described and shown.

I claim:

1. A sock protector arrangement comprising:

a) a sock having a toe portion, a heel portion and an instep portion connecting said toe portion to said heel portion of said sock;

b) a sleeve having a forwardmost end, a rearwardmost end and a body connecting said forwardmost end to said rearwardmost end, said body having an upper section, a lower section, a sewn seam connecting said upper section of said body to said lower section of said body, said sewn seam having a first end intersecting said rearwardmost end of said sleeve at a first area of said rearwardmost end of said sleeve and a second end intersecting said rearwardmost end of said sleeve at a second area of said rearwardmost end of said sleeve and extending around said body, and first and second reinforcing elements located in said first and second areas respectively;

c) said rearwardmost end of said sleeve being open and having a rim that extends on said upper section of said body of said sleeve on said first and second ends of said sewn seam and said lower section of said body of said sleeve, said rearwardmost end of said sleeve having a first inner dimension and said forwardmost end of said sleeve having a second inner dimension, said first inner dimension being larger than said second inner dimension with said body of said sleeve tapering in size from said first inner dimension to said second inner dimension; and d) said sleeve being entirely located inside said toe portion of said sock with said rearwardmost end of said sleeve being positioned between said toe portion of said sock and said instep portion of said sock when in use wherein only a wearer's toes are covered by said sleeve when said sleeve is worn by the wearer.

2. The sock protector arrangement as described in claim 1 wherein said sleeve is constructed of nylon.

3. The sock protector arrangement as described in claim 2 further including a vent hole defined through said sleeve.

4. The sock protector arrangement as described in claim 3 wherein said sleeve is substantially conical in shape.

* * * * *